US008438886B2

(12) United States Patent
Bourgain et al.

(10) Patent No.: US 8,438,886 B2
(45) Date of Patent: May 14, 2013

(54) DEVICE FOR LOCKING THE DOORS OF A SHOWCASE

(75) Inventors: Eric Bourgain, Paris (FR); Jean-Jacques Masson, Fontenay Sous Bois (FR); Christophe Martin, Tremblay en France (FR)

(73) Assignee: Adler S.A.S., Moussy-le-Neuf (FR)

( * ) Notice: Subject to any disclaimer, the term of this patent is extended or adjusted under 35 U.S.C. 154(b) by 78 days.

(21) Appl. No.: 12/917,909

(22) Filed: Nov. 2, 2010

(65) Prior Publication Data

US 2011/0273066 A1 Nov. 10, 2011

(30) Foreign Application Priority Data

Nov. 2, 2009 (FR) ..... 09 57736

(51) Int. Cl.
*E05B 65/44* (2006.01)
*A47F 3/00* (2006.01)

(52) U.S. Cl.
USPC ..... 70/78; 70/DIG. 19; 70/81; 70/100; 70/276; 70/360; 70/369; 70/371; 70/492; 312/139.2

(58) Field of Classification Search ..... 70/DIG. 19, 70/DIG. 78, DIG. 79, DIG. 80, DIG. 26, 70/492, 276, 95–100, 360, 361, 367–371, 70/78, 81; 292/251.5, DIG. 46, DIG. 15; 321/139.2
See application file for complete search history.

(56) References Cited

U.S. PATENT DOCUMENTS 1,845,867 A * 2/1932 Ellingson ..... 70/340
1,907,625 A * 5/1933 Vogt ..... 70/100
3,102,411 A * 9/1963 Friedman ..... 70/100
3,956,911 A * 5/1976 Corboud ..... 70/100
4,741,186 A * 5/1988 Martin ..... 70/100
4,813,723 A * 3/1989 Anderson et al. ..... 292/336.3
5,099,663 A * 3/1992 Dearstine ..... 70/77
6,041,627 A * 3/2000 Buckland ..... 70/78
6,843,082 B2 * 1/2005 Vickers ..... 70/83
7,174,944 B1 * 2/2007 Clark et al. ..... 160/197

(Continued)

FOREIGN PATENT DOCUMENTS

DE 94 09 634 10/1995
DE 20 2006 008992 10/2007
NL 1 029 101 11/2006

OTHER PUBLICATIONS

Preliminary Search Report corresponding to the European FR/0957736 application, Aug. 17, 2010.

*Primary Examiner* — Lloyd Gall
*Assistant Examiner* — Myles Throop
(74) *Attorney, Agent, or Firm* — Kilpatrick Townsend & Stockton LLP

(57) ABSTRACT

The invention provides a showcase having at least two glass doors, a first door being fastened to a front ferrule and a second door being fastened to a rear ferrule, each of the ferrules moving along a respective rail, said locking device comprising a lock for locking the two doors together, wherein the showcase includes a locking device comprising a slider mounted to move in said front ferrule transversely relative thereto, and having a rotor of the lock installed thereon, wherein said rear ferrule includes an opening that comes into line with said rotor in a position for locking the two doors together, and that is suitable for receiving a bolt mounted at the end of said rotor, and wherein said slider includes a relatively flat face plate coming substantially flush with said ferrule in the locked position of said doors.

15 Claims, 5 Drawing Sheets

U.S. PATENT DOCUMENTS

| | | | | |
|---|---|---|---|---|
| 7,409,842 | B2 * | 8/2008 | Kuo | 70/58 |
| 2001/0030606 | A1 * | 10/2001 | Jaffe et al. | 340/545.6 |
| 2005/0016234 | A1 * | 1/2005 | Strader et al. | 70/492 |
| 2006/0000251 | A1 * | 1/2006 | Ceron et al. | 70/492 |
| 2011/0266931 | A1 * | 11/2011 | Eric et al. | 312/139.2 |
| 2011/0283751 | A1 * | 11/2011 | Avganim | 70/18 |

* cited by examiner

DEVICE FOR LOCKING THE DOORS OF A SHOWCASE

The invention relates to a showcase, and more particularly to a device for locking such a showcase.

BACKGROUND OF THE INVENTION

Sliding glass doors for showcases are known that are arranged on running tracks. They are conveniently offset relative to each other in the depth direction. The glass doors are engaged in rectilinear section members referred to below as ferrules, that form narrow straight strips below the glass.

Locks suitable for this type of showcase exist in two types. Firstly there are electromagnetic locking devices that are entirely suitable in terms of a pleasing appearance for such doors, but that are suitable for luxury applications only since the cost of such devices is particularly high. Secondly there are mechanical locking devices that are much less expensive, but not very attractive. Mechanical devices include locks with racks that are very visible and impede the transparency of the structure, since they are fixed to the glass, often in the middle of the door. Locks that pass through both glass doors via their metal ferrules avoid any need to machine the glass, but they are often constituted by a block inserted in a telescopic body on a spring that becomes ejected on unlocking with a key, thereby releasing the rear door from the front door. Such a device is particularly bulky and forms a staged cylindrical projection typically extending about 30 millimeters (mm) perpendicularly from the front ferrule, even in the locked position.

The presence of such a projection and the unattractive appearance of the lock are generally not suitable for making showcases for use in luxury stores where clean lines and great transparency are desired.

OBJECT AND SUMMARY OF THE INVENTION

The present invention seeks to remedy that drawback, and an object of the invention is to create a device for locking together two sliding glass doors in a manner that is particularly attractive, inconspicuous, and inexpensive.

In particular, the invention proposes using a lock rotor and mounting it directly in a moving part incorporated in the ferrule or in an endpiece mounted at the end of a ferrule.

The invention provides a showcase having at least two glass doors, a first door being fastened to a front ferrule and a second door being fastened to a rear ferrule, each of the ferrules moving along a respective rail, said locking device comprising a lock for locking the two doors together, wherein the showcase includes a locking device comprising a slider mounted to move in said front ferrule transversely relative thereto, and having a rotor of the lock installed thereon, wherein said rear ferrule includes an opening that comes into line with said rotor in a position for locking the two doors together, and that is suitable for receiving a bolt mounted at the end of said rotor, and wherein said slider includes a relatively flat face plate coming substantially flush with said ferrule in the locked position of said doors.

Advantageously, each ferrule includes an endpiece of similar profile fitted to one end thereof, said endpieces facing each other in the position for locking the doors together, the endpiece of the front ferrule carrying said slider and said rotor, and the rear endpiece of the rear ferrule including said opening.

In an embodiment of the invention, the slider includes resilient return means urging the lock towards the unlocked position.

Preferably, said rotor is of the wafer tumbler type and the slider includes a transverse cotter pin for guiding the slider and for holding the wafer tumblers of the rotor.

According to a characteristic of the invention, the front endpiece includes at least one helical guide means for guiding the rotor during locking or unlocking of the doors.

According to another characteristic of the invention, the guide means include at least one lug projecting radially from the bolt and engaged in a helical groove of the front endpiece.

BRIEF DESCRIPTION OF THE DRAWINGS

The invention can be better understood and other advantages thereof appear better in the light of the following description given purely by way of example and made with reference to the accompanying drawings, in which.

MORE DETAILED DESCRIPTION

Figure 1:
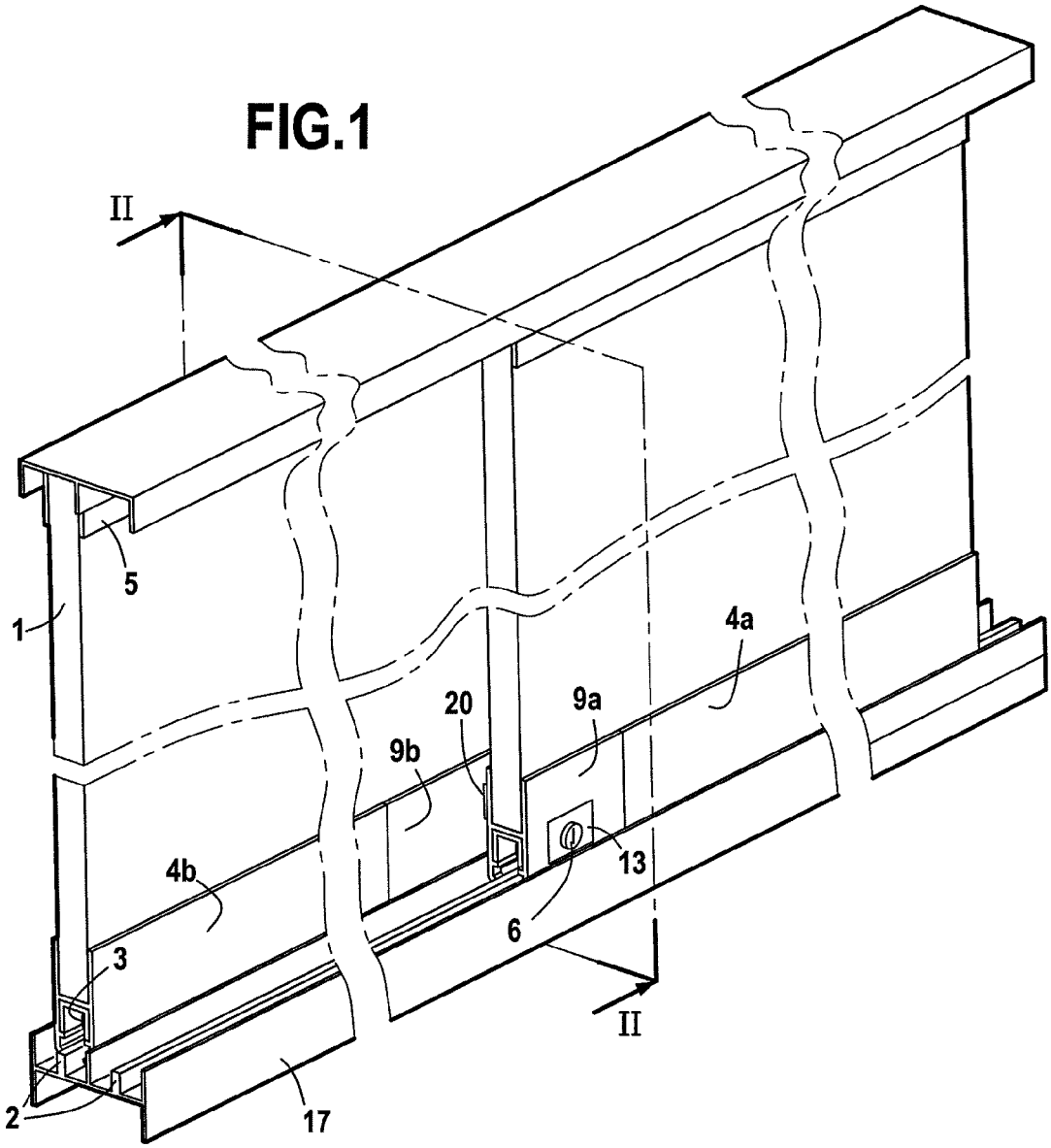
FIG. 1 is a perspective view of two sliding glass doors in the locked position in a cabinet of the present invention.

With reference to the figures, there are shown two sliding glass doors 1 of a cabinet forming a showcase, the doors being capable of moving along a rail 2 mounted on a bottom structure 17. The doors are mounted to slide on the rail via wheels 3 that are inserted in and fitted to ferrules 4*a*, 4*b* in the form of H section members, and in endpieces 9*a*, 9*b* of similar section mounted respectively at the ends of said ferrules 4*a*, 4*b*. The bottom portions of the doors are rabbeted in said ferrules 4*a*, 4*b* and in the endpieces 9*a*, 9*b* using silicone adhesive or clamping by any appropriate means. The top portions of the doors are merely guided by a channel-section member 5. In the description below, it may be considered that the endpiece forms a part of the ferrule.

In this embodiment of the invention, there is a front endpiece 9*a* mounted at the end of a front ferrule 4*a*, said front endpiece including a lock 6, and there is a rear endpiece 9*b* mounted at the end of a rear ferrule 4*b*, said endpiece 9*b* including an opening 15 suitable for receiving the bolt 12 that is mounted at the end of a rotor 7 of the lock 6.

Figure 4:
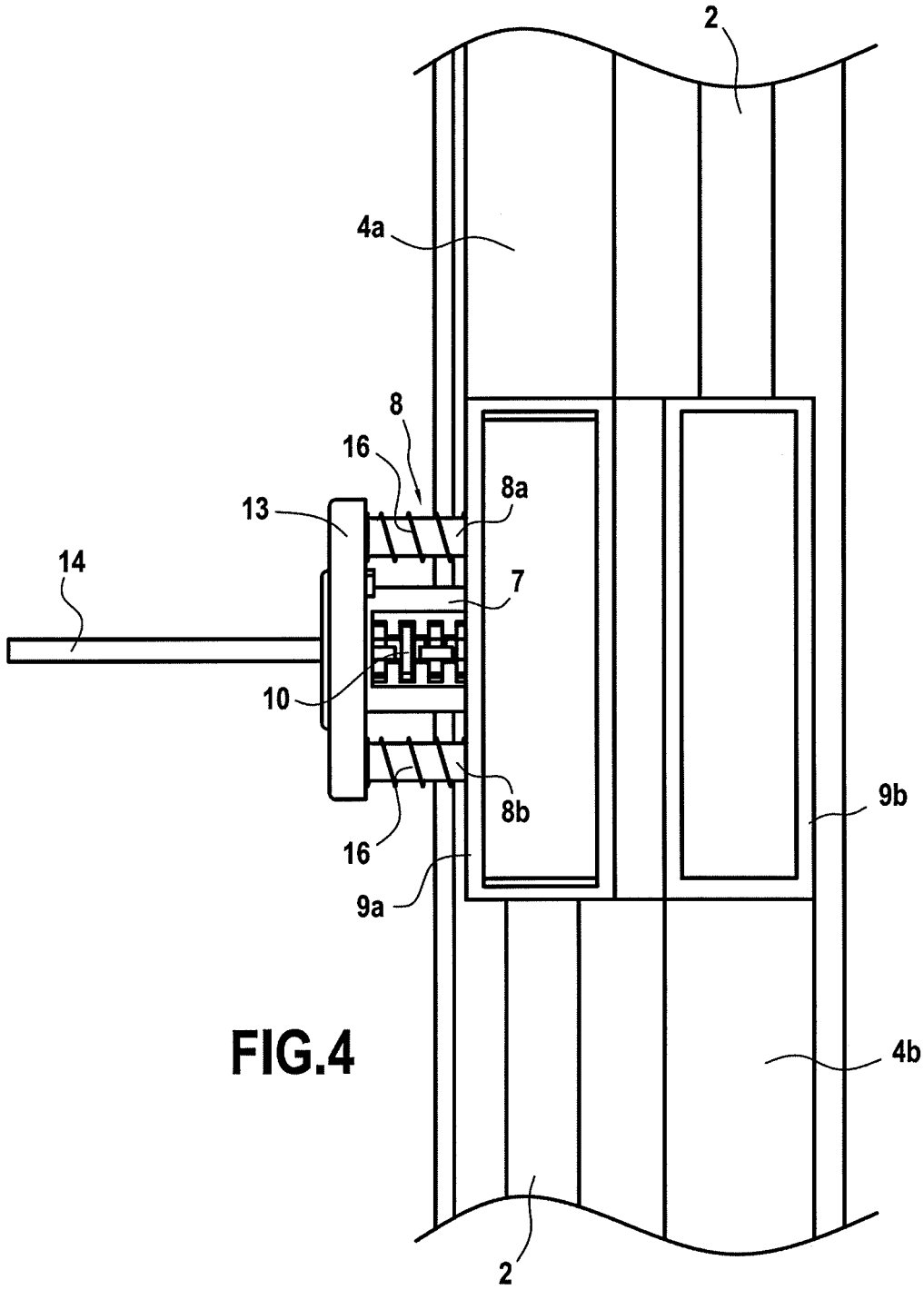
FIG. 4 is a plan view of the device of the present invention for locking two sliding glass doors.
Figure 5:
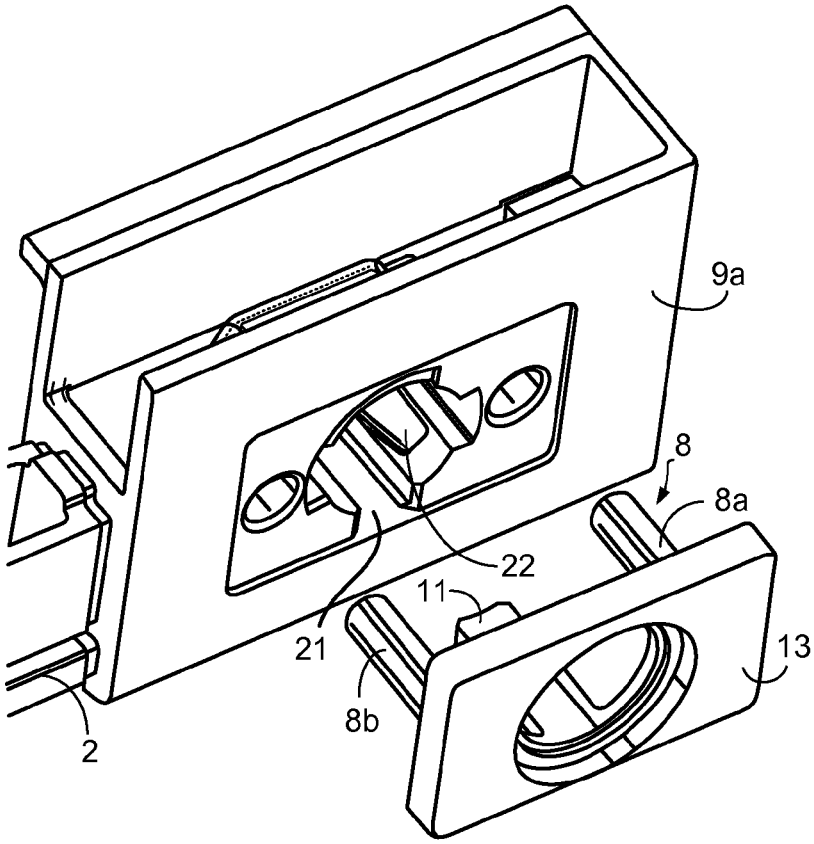
FIG. 5 is an exploded perspective view of a front endpiece and of the ferrule suitable for receiving the rotor.
Figure 6:
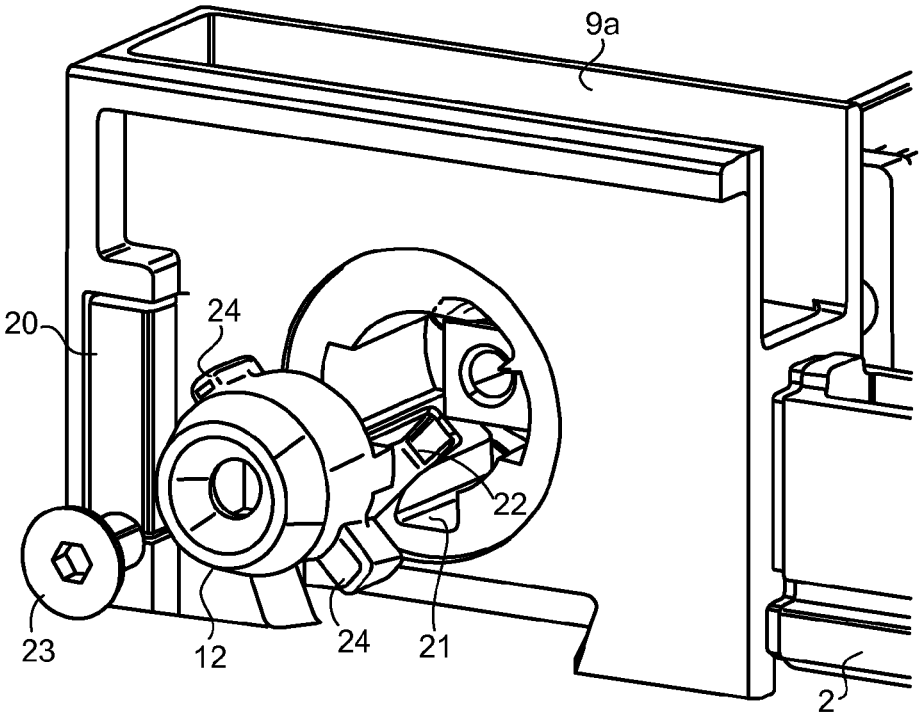
FIG. 6 is an exploded perspective view showing the rear of a front endpiece and showing in particular the structure of the axial bolt and the curved grooves enabling the rotor to be turned at the same time as the slider is moved.
Figure 7:
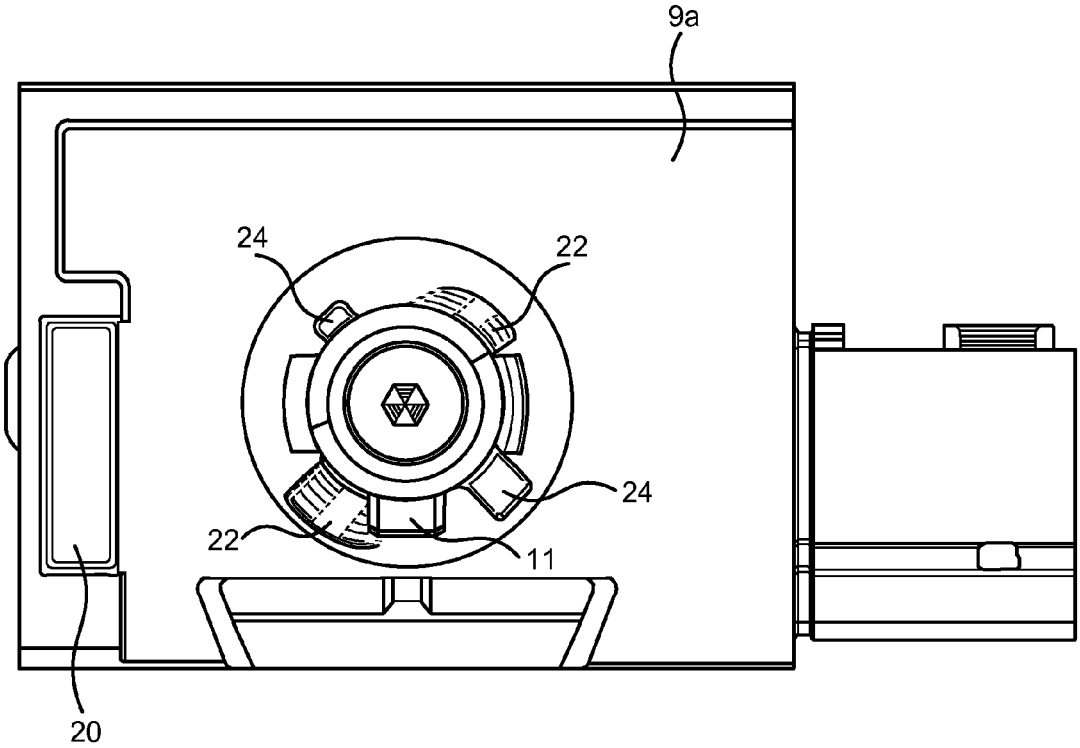
FIG. 7 is a view of the rear wall of the front endpiece showing the locked bolt with its lugs bearing against the rear wall of the front endpiece.

More precisely, the rotor 7 is mounted in a slider 8 so as to cause the lock 6 to move from a locking position in which the slider 8 is engaged in the front endpiece 9*a*, which thus constitutes the stator of the lock 6, to an unlocking position in which the slider 8 is disengaged outwards. In the embodiment shown in FIG. 4, the slider 8 includes a relatively flat face plate 13 and two rods 8*a*, 8*b* arranged on either side of the rotor 7, said rods providing some of the guidance of the slider and being provided with resilient return means 16 such as springs mounted around them. The springs 16 are suitable for being compressed in the locked position of the lock 6 and for being relatively relaxed in the unlocked position of the lock.

In the example, the rotor 7 is of the type having wafer tumblers 10. The wafer tumblers are supported by a cotter pin 11 of the slider 8 extending parallel to the travel direction of the slider under the rotor 7. The cotter pin 11 serves to eject the rotor 7 and the bolt 12 associated therewith and it is preferably arranged to be secured to the rear of the relatively flat face plate 13 of the slider 8 that receives the front disk of the rotor 7 defining the opening for receiving a key 14. It thus serves to prevent any damage to the wafer tumblers and to prevent them dropping out from a rotor 7 having free wafer tumblers while the said rotor is being ejected as the lock 6 passes into its unlocked position. The cotter pin 11 is received in a groove 21 formed in the front endpiece 4*a* and thus constitutes an additional guide for guiding the sliding of the slider 8. Thus, the rotor 7 occupies nearly all of the empty space between the bottom end of the glass door in the endpiece 9*a* and the top of the rail 2.

Advantageously, the face plate 13 is as thin as possible in order to give as pleasing as possible an appearance to the showcase when the lock is in the locked position, with the face plate 13 in this position resting against the outside surface of the front endpiece 9*a*.

As mentioned above in the description, the rotor 7 includes a bolt 12 projecting from its free end and suitable for co-operating with the opening 15 defined in the rear endpiece 9 when the lock is in the locked position. The opening 15 has a diameter that is significantly greater than the diameter of the bolt 12 and it enables the two sliding glass doors to be blocked together. With a sloping showcase, the opening 15 in the endpiece 9*b* need not be in alignment with the bolt 12 of the rotor 7, so the opening 15 may then be of elongate shape and, in particular of oblong shape in order to receive the cylindrical bolt 12 and enable the two doors 1 to be locked together.

In order to make the doors 1 easier to lock and unlock, the front endpiece 9*a* includes helical guide means (not shown) for guiding the rotor 7 during unlocking and locking of the doors 1. The guide means comprise at least one lug 24 projecting radially from the bolt 12 and engaged in a helical groove 22 in the front endpiece 9*a*. Advantageously, two lugs 24 of the bolt 12 co-operate with two helical grooves 22 of the front endpiece 9*a*. In the locked position of the lock 6, the lugs 24 bear against the rear wall of the front endpiece 9*a* and block the slider 8 in the front endpiece 9*a*. In this position, the end of the bolt 12 is engaged in the opening 15 to block the rear glass door 1. The movements in translation and in rotation of the rotor 7 take place simultaneously during ejection and penetration of said rotor and said bolt that is attached thereto. The bolt 12 is fastened to the rear of the rotor by means of a screw 23.

The facing endpieces also include an indexing device for indexing one glass door relative to the other so as to cause the glass doors to match each other and thus simplify the operation of locking or unlocking. The indexing device may comprise at least one positioning magnet 20, preferably in the form of a strip. For example, such a magnet is placed vertically at the end of each endpiece. This serves to ensure the positioning of the opening 15 in the rear endpiece 9*b* relative to the bolt 12 of the rotor 7 so as to facilitate penetration or retraction of the bolt 12 in the opening 15 without obstacles. This indexing presents an advantage in ergonomic and quality terms since it serves to assist in fully locking the glass doors together.

Figure 2:
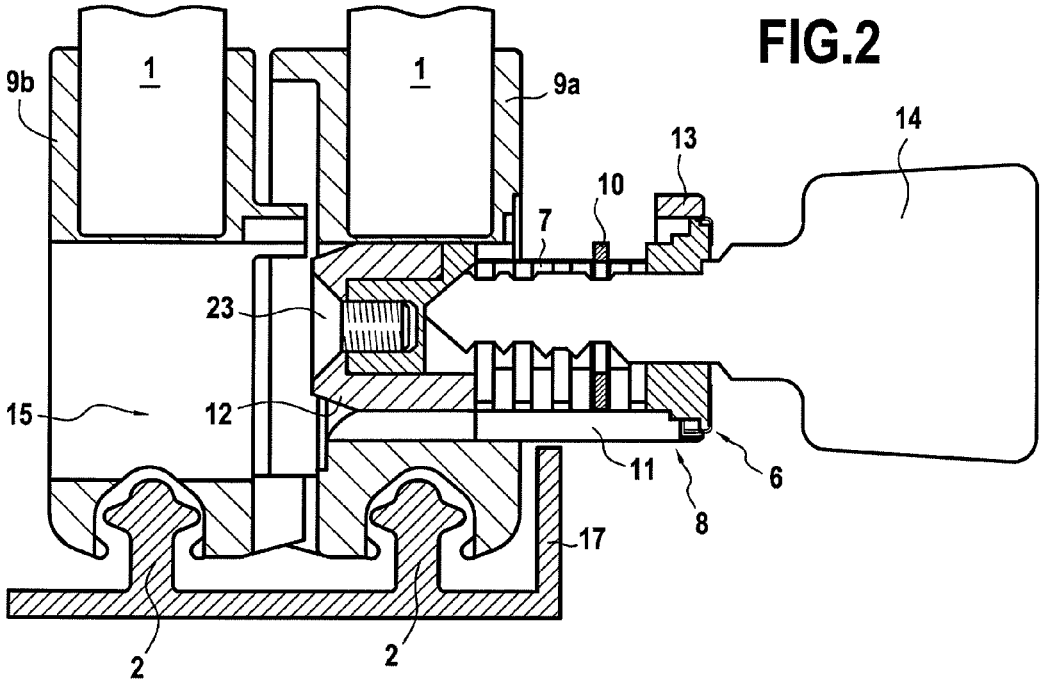
FIG. 2 is a fragmentary section view on line II-II of FIG. 1 showing the device of the present invention for locking two sliding glass doors prior to the key performing the locking operation.
Figure 3:
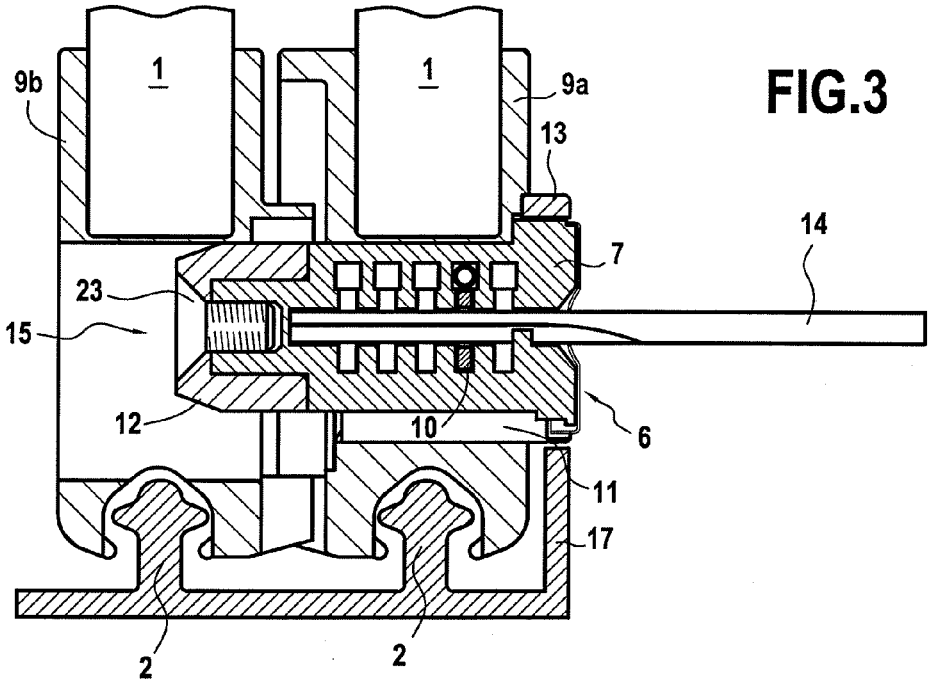
FIG. 3 is a fragmentary section view on the same line showing the device of the present invention for locking two sliding glass doors, after the locking operation has been performed by a key.

Thus, in this embodiment of the invention, on passing from an unlocked position shown in FIG. 2 to a locked position of the lock 6 as shown in FIG. 3, the user inserts the key 14 in a key-reception opening in the front disk of the rotor 7 in the face plate 13. The user then begins to cause the rotor 7 to penetrate in the front endpiece 9*a* by pushing the rotor 7, and thus the key 14, towards the endpiece 9*a*, with the rotor 7 and the guide cotter pin 11 of said rotor 7 entering respectively into an opening formed in the front endpiece 9*a* and into the groove 21 in the endpiece 9*a* that are suitable for receiving them. The springs 16 compress during this penetration operation. Because the rotor is guided helically, by engaging the penetration action the user simultaneously causes the key 14 to turn in the locking direction. The lugs 24 are then guided in the helical grooves of the front endpiece 9*a* until they escape from the rear of said endpiece. The user continues to turn the key so the lugs 24 become pressed against the rear wall of the front endpiece 4*a*, and the rotor 7 comes to rest. In this position, the axial portion of the bolt 12 is situated behind the lugs 24 and is inserted in the opening 15 defined in the rear endpiece 9*b*, thereby blocking the rear glass door. Locking is thus complete. The face plate 13 is pressed against the outside surface of the front endpiece 9*a* and projects laterally very little from the endpiece.

Conversely, the lock 6 is taken from the locked position to the unlocked position in a manner similar to that described in the above paragraph, i.e. by turning the key 14 in the opposite direction. The lugs 24 are turned until they coincide with the openings of the helical grooves 22. Once the lugs 24 are in the grooves 22, the rotor 7 is ejected automatically from the front endpiece 9*a* constituting the stator of the lock 6 in place. Because of the guiding cotter pin 11 and because of the pressure from the relaxing resilient return means 16 ejection is automatic once the key has turned through half a turn in the direction for unlocking the lock 6, or quarter of a turn depending on the type of rotor used.

By means of the invention, and in particular by means of the way the rotor is arranged to slide relative to the ferrule or to the endpiece, horizontal locking of one or two sliding glass doors is made secure, and the appearance of the glass door is made attractive at smaller cost. The presence of indexing means for indexing the glass doors to each other, the presence of helical guide means for the rotor, and the presence of resilient return means for the slider of the rotor makes the locking device of the invention particularly ergonomic for a user. Furthermore, the fact that the device is made in the endpieces mounted on the ferrules makes the invention particularly easy to implement, since machining an endpiece of small size is simpler than machining a ferrule of much greater size. Finally, it is possible to replace existing ferrule endpieces with ferrule endpieces as described above in order to use the locking device of the invention.

In a variant of these embodiments, the top portion of the glass door may also be mounted in a top front ferrule and the lock may be received in a front endpiece mounted at the end of the top front ferrule, said lock then being capable of co-operating with an opening formed in a rear endpiece formed in a top rear ferrule. Furthermore, the rotor could equally well be a pin tumbler cylinder instead of a wafer tumbler cylinder.

What is claimed is:

1. A showcase having at least two glass doors, a first door being fastened to a front ferrule and a second door being fastened to a rear ferrule, each of the ferrules moving along a respective rail, and a locking device comprising a lock for locking the two doors together, wherein the showcase includes said locking device comprising a slider mounted to move in said front ferrule transversely relative thereto, and having a rotor of the lock installed thereon, wherein said rear ferrule includes an opening that comes into line with said rotor in a position for locking the two doors together, and that is suitable for receiving a bolt mounted at the end of said rotor, and wherein said slider includes a relatively flat face plate coming substantially flush with said front ferrule in the locked position of said doors, wherein said rotor is of a wafer tumbler type and wherein the slider includes a transverse cotter pin for holding the wafer tumblers of the rotor, said cotter pin being received in a groove of the front ferrule for guiding the slider.

2. A showcase according to claim 1, wherein the slider includes resilient return means urging the lock towards the unlocked position.

3. A showcase according to claim 1, wherein each ferrule includes an endpiece of similar profile fitted to one end thereof, and wherein said endpieces face each other in the position for locking the doors together, a front endpiece of the front ferrule carrying said slider and said rotor, and a rear endpiece of the rear ferrule including said opening.

4. A showcase according to claim 3, wherein the front endpiece includes at least one helical guide means for guiding the rotor during locking or unlocking of the doors.

5. A showcase according to claim 4, wherein the guide means include at least one lug projecting radially from the bolt and engaged in a helical groove of the front endpiece.

6. A showcase according to claim 4, wherein a lug bears against a rear wall of the front endpiece in the locked position of the lock.

7. A showcase according to claim 4, wherein two lugs of the bolt co-operate with two helical grooves of the front endpiece.

8. A showcase according to claim 7, wherein the bolt is extended by an axial portion behind the lugs, said axial portion being suitable for entering into the opening in order to block the second glass door.

9. A showcase according to claim 3, wherein side walls of the endpieces that face each other include indexing means for indexing one glass door relative to the other.

10. A showcase according to claim 9, wherein the indexing means comprise at least one positioning magnet.

11. A showcase according to claim 10, wherein said magnet is disposed vertically at the end of an endpiece.

12. A showcase according to claim 10, wherein said magnet is in the form of a strip.

13. A showcase according to claim 1, wherein said slider comprises a first rod arranged on a first side of the rotor and a second rod arranged on a second side of the rotor.

14. A showcase according to claim 13, wherein a first resilient return mechanism is mounted around said first rod and a second resilient return mechanism is mounted around said second rod.

15. A showcase according to claim 14, wherein each of the first and second resilient return mechanisms comprises a spring.

* * * * *